United States Patent [19]

Matter et al.

[11] 4,200,143

[45] Apr. 29, 1980

[54] CONTINUOUS HORIZONTAL CASTER

[75] Inventors: Robert C. Matter; James R. Bish, both of Anderson, Ind.

[73] Assignee: General Motors Corporation, Detroit, Mich.

[21] Appl. No.: 819,897

[22] Filed: Jul. 28, 1977

[51] Int. Cl.[2] ..... B22D 11/10; B22D 37/00

[52] U.S. Cl. ..... 164/440; 164/82; 222/318; 222/594

[58] Field of Search ..... 164/82, 434, 437, 439, 164/440, 335, 337, 133; 222/594, 424, 318

[56] References Cited

U.S. PATENT DOCUMENTS

| | | | |
|---|---|---|---|
| 2,582,802 | 1/1952 | Terrell, Jr. | 222/318 X |
| 3,894,577 | 7/1975 | Milyaev et al. | 164/440 X |
| 4,030,538 | 6/1977 | Carbonnel | 164/133 X |

FOREIGN PATENT DOCUMENTS

| | | | |
|---|---|---|---|
| 636200 | of 1963 | Belgium . | |
| 1211763 | 3/1966 | Fed. Rep. of Germany | 164/337 |
| 1956550 | 11/1970 | Fed. Rep. of Germany | 164/437 |
| 47-211 | 11/1972 | Japan | 164/437 |

*Primary Examiner*—Robert D. Baldwin
*Assistant Examiner*—Gus T. Hampilos
*Attorney, Agent, or Firm*—Lawrence B. Plant

[57] ABSTRACT

Apparatus for continuously casting metal strips at various rates wherein and whereby a non-turbulent, constant-head, constant-temperature source of dross-free melt is provided to the casting nozzle by pumping the melt from a reservoir upwardly through a standpipe open midway to the nozzle and overflowing it from the standpipe back to the reservoir. An adjustable wire atop the standpipe controls the metalostatic head above the casting nozzle, and a reversible pump permits ready aborting of a casting run.

1 Claim, 7 Drawing Figures

CONTINUOUS HORIZONTAL CASTER

This invention relates to the continuous horizontal casting of molten metals into lengths of strip, rod, etc. More specifically, this invention relates to method and apparatus for supplying substantially dross-free melt to a casting nozzle at substantially constant temperature and pressure regardless of casting speed variations during the course of a casting run. The invention is particularly suitable to the continuous casting of strips from dross-prone melts such as the Pb-Ca alloys.

Continuous metal casters require a substantially constant pressure and temperature and a non-turbulent supply of dross-free melt to produce defect-free castings on a substantially uninterrupted basis. Traditionally, this has been accomplished by gravity feeding quiescent melt to the casting nozzle from near the bottom of a casting pot having level detector means to control the level within the vessel. Molten metal is transferred or metered from a holding vessel to the pot as called for by the level detector means, and temperature control means and heaters are usually employed to control the melt temperatures in both the vessel and the pot.

Such devices are essentially constant speed casters which operate most efficiently only when steady state conditions exist, and casting speed changes generally require stopping a casting run and changing the melt metering or transferring rate, and often complex temperature control equipment preclude temperature variations during the course of a run. None, to Applicants' knowledge, permit casting speed changes during the course of a casting run with virtually no adjustments to the melt supply, temperature or level control systems. Moreover, Applicants' are unaware of any such system which may conveniently be shut down to abort a casting run or removed for maintenance without unnecessary relocation of melt or running the risk of "freeze-ups" in the equipment.

It is therefor a principal object of the present invention to provide a continuous horizontal casting process and apparatus for maintaining a substantially thermally and metalostatically invarient supply of non-turbulent, dross-free melt behind the casting nozzle regardless of casting rate changes during the course of a casting run. A further object of this invention is to provide such an apparatus in a form which can readily be shut down without engendering "freeze-ups" in the caster and supporting equipment.

These and other objects and advantages of the invention will become more readily apparent from the description which follows and particularly as it relates to FIG. 1 hereof.

SUMMARY OF THE INVENTION

In accordance with this invention, the source of melt for the casting nozzle includes a continuously overflowing standpipe partially immersed in a reservoir of the melt. The casting nozzle is located above the level of the melt in the reservoir and between the inlet and outlet of the standpipe to tap off melt from the standpipe as it flows upwardly therethrough. A pump near the bottom of the standpipe circulates melt from the reservoir upwardly through the standpipe, past the casting nozzle and over a variable height weir atop the standpipe from whence it returns to the reservoir. The weir atop the standpipe is adjustable for varying the head of melt above the nozzle and once set will substantially fix that metalostatic head regardless of casting rate variations so long as the volumetric pumping rate exceeds the volumetric casting rate. The pumping rate is preferably fixed at a rate which only slightly exceeds the maximum casting rate hence insuring that at least some melt overflows the weir regardless of casting rate. Such a flow rate does not induce any turbulence in the standpipe which would affect either the casting rate or the quality of the cast strip. The melt overflow returns and merges with the melt in the reservoir thereby achieving substantial temperature equalization throughout the system. Withdrawal of the melt from below its level in the reservoir as well as supplying it to the casting nozzle beneath its level in the standpipe insures that only dross-free melt is presented to the casting nozzle hence eliminating dross-entrapment as a source of defects in the casting.

A significant advantage of this invention is the ability to quickly shut down the caster in the event a casting run must be aborted. In this regard, by simply reversing the pump, the melt in the standpipe, casting block and nozzle is quickly returned to the reservoir via the standpipe's bottom inlet where it is maintained in molten condition immediately ready for another casting run.

Lastly and in a preferred embodiment of the invention, the standpipe pump as well as the casting nozzle are so associated with the melt reservoir and each other that each can be quickly and readily removed or separated from the other (e.g., for servicing or replacement) without significantly disturbing the melt.

DETAILED DESCRIPTION

Figure 1:
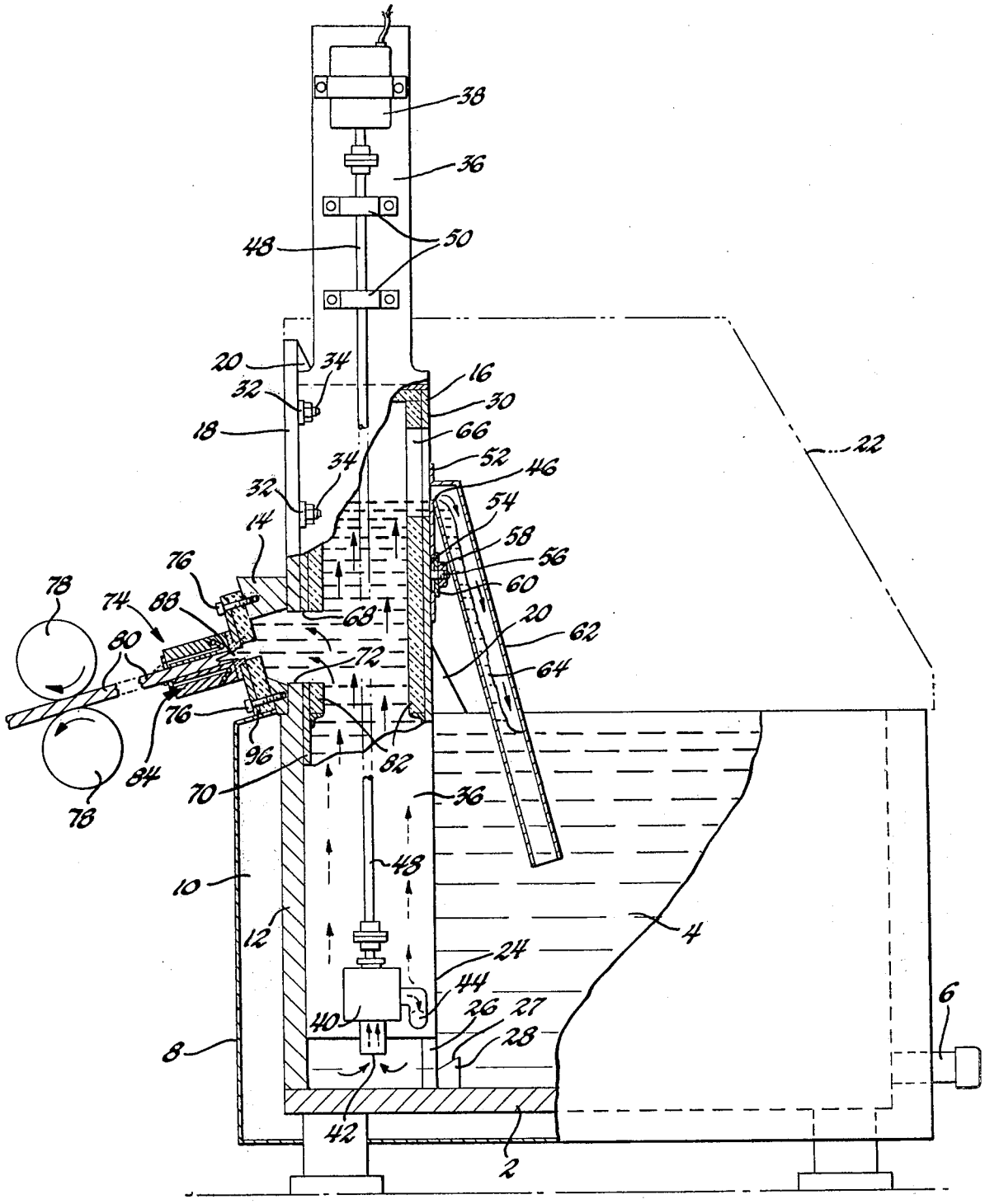
FIG. 1 is a partially broken away and sectioned side elevational view of a continuous casting apparatus illustrative of the invention.

FIG. 1 depicts a continuous caster including a heated reservoir 2 for holding a melt 4 at a predetermined temperature. The reservoir may be lined with insulating brick or the like (not shown) depending on the composition and temperature of the melt 4. A capped drain pipe 6 is provided at one end of the reservoir 2 for emptying during off periods and for maintenance. The reservoir 2 is encased in sheet metal 8 which provides an insulating air gap 10 thereabout. One of the walls 12 defining the reservoir 2 extends vertically upward and serves to support a casting chamber block 14 on one side thereof and a casting standpipe 16 on the other side thereof. Braces 20, on either side of the standpipe 16, are appropriately affixed to the other reservoir walls and serve to reinforce the vertical extension 18. The reservoir 2 and standpipe 16 are covered by a shroud 22 (shown in phantom) to minimize heat losses and contain controlled atmospheres (e.g., argon), which may desirably be employed over the melt 4 to reduce drossing thereof.

The casting standpipe 16 has its lower end 24 submerged below the level of the melt 4 in the reservoir 2 and supported above the bottom of the reservoir 2 on a pedestal 26. When the standpipe is inserted into the reservoir 2, the pedestal 26 engages the inclined surface 27 of a positioning block 28 on the floor of the reservoir 2. The inclined surface 27 causes the lower end 24 to move against the wall 12 and drop into place between the wall 12 and the block 28 for securing the lower end 24 in place. The upper end 30 of the standpipe 16 is provided with earlike flanges 32 for securing the standpipe to the vertical extension 18 via threaded studs 34.

One of the walls 36 (here forefront) of the standpipe 16 (which is rectangular in horizontal cross section) extends above and beyond the remainder of the standpipe 16 and conveniently serves to mount a reversible motor 38. The motor 38 is connected by a drive shaft 48 to a reversible pump 40 at the bottom of the standpipe 16. The drive shaft is journalled, as at 50 and as necessary, along the length of the wall 36. The pump 40 has an inlet 42 for receiving melt 4 from the reservoir 2 and an outlet 44 for delivering that melt into the standpipe 16 and pumping it upwardly therethrough during casting to an overflow weir 46 located near the top of the standpipe 16 and above the casting zone adjacent the casting chamber block 14. To abort a casting or shut down the caster the motor and pump are reversed and the flow reversed in the respective inlet and outlet.

Height of the melt in the standpipe 16, and hence, the metalostatic head in the casting zone, is controlled by the location of the weir 46 which is adjusted by moving a slide plate 52 up or down along the side of the standpipe 16 to position the weir 46 as desired at the melt exit opening 66 near the top of the standpipe 16. An elongated vertical slot 54 is provided in the slide plate 52 through which a threaded stud 56 on the side of the standpipe 16 extends. A nut 58 and washer 60 serve to clamp the plate 52 to the outside wall of the standpipe 16 in the desired location. Downcomer 62 is appropriately attached to the slide plate 52 adjacent the weir 46 for conducting the melt overflow 64 back to the melt 4 in the reservoir 2. A port 68 through the wall 70 and insulation 82 of the standpipe 16 is registered with a like port in the vertical extension 18 and serves to supply melt from the standpipe 16 to a casting nozzle and throat assembly 74. The casting nozzle and throat assembly 74 is affixed to the casting block 14 as by bolts 76, or appropriate quick-disconnect means. The casting block 14 may be heated to more precisely control the temperature of the melt just prior to entering the mold. Casting nozzle and throat assemblies 74 are discussed in more detail hereinafter in conjunction with the other figures.

In operation, the reservoir 2 is filled with melt 4 to an appropriate level and its temperature maintained at a predetermined level therein by appropriate heaters (not shown). Pump 40 is then energized so as to circulate melt from the reservoir 2 upwardly through the standpipe 16, over the weir 46 and through the downcomer 62 back to the melt 4. The pumping rate is such as to insure a volumetrically flow rate (i.e. $ft^3$/min) into the standpipe 16 which is higher than the volumetric removal rate of the metal as strip 80 and thereby insure a continuous stream of overflow melt 64 returning to reservoir 2. The flow rate is preferably held constant at a rate which exceeds the maximum casting rate capability of the caster and hence only the overflow rate will vary as the casting rate varies. Casting is commenced by inserting an appropriate starter strip into the outlet of casting nozzle assembly 74 and causing the melt flowing into the assembly to attach itself to the starter strip. The starter strip is then engaged by pull rollers 78 and withdrawn from the casting nozzle assembly 74 at a rate determined by the speed of the rollers 78—slowly at first and then increasingly until full casting speed is achieved. The casting rate (i.e., ft/min) of the strip 80 is determined by the ability to pull the strip 80 out of the nozzle assembly 74 without tearing or rupturing the thin skin of solidified metal initially formed at the melt inlet end 88 of the assembly 74.

Automatic control and starting of the caster may be accomplished by means of appropriate sensors and timers (not shown). In this regard, the molten metal pump 40 is energized and the melt level in the standpipe 16 rises to above the opening 68 at which time a level sensor detects the presence of the metal and energizes the rolls 78 at slow speed so as to slowly withdraw the starter strip. After a suitable timed delay sufficient to allow the melt level in the standpipe 16 to reach the overflow weir 46, the speed of the rolls 78 is increased to the desired casting speed. Upon stopping or aborting of the casting the pump 40 is reversed causing the melt level in the standpipe 16 to drop to the aforesaid level indicator which stops the rolls 78. Pumping would continue until after an appropriate timed delay to empty the standpipe at which time the pump 40 would shut down.

Figure 2:
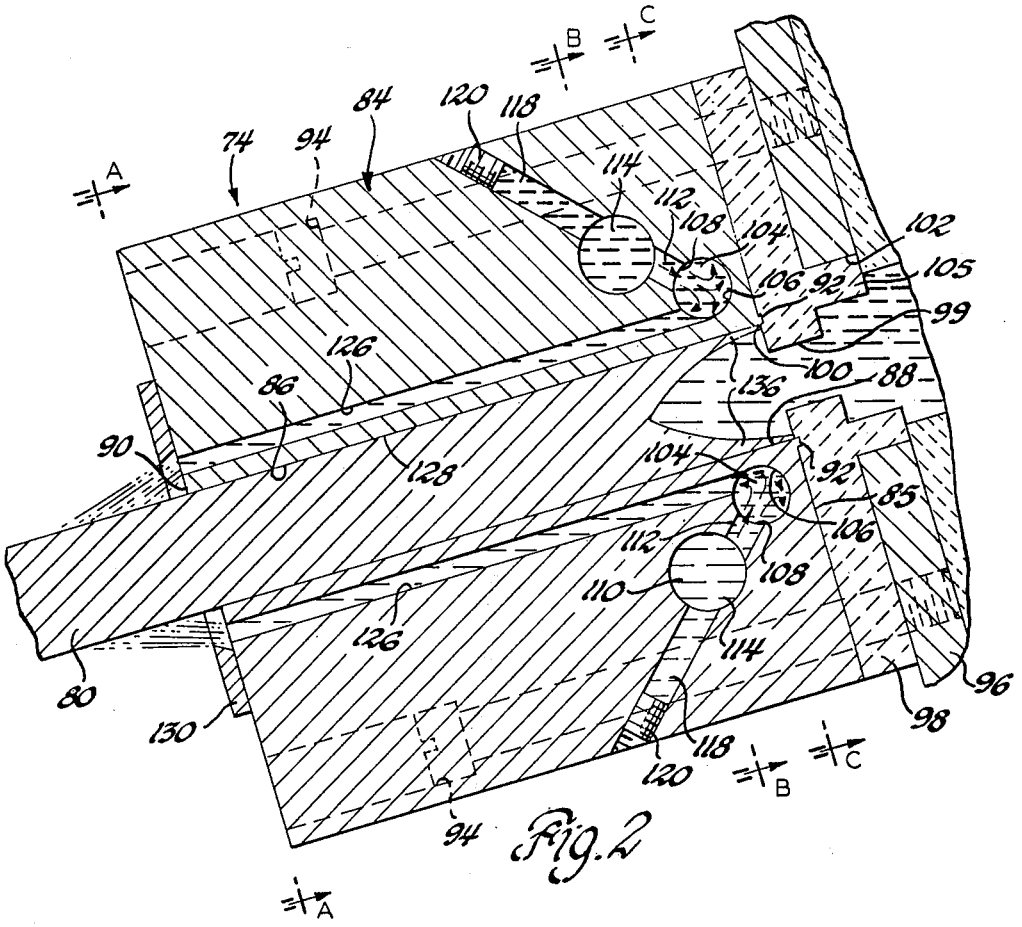
FIG. 2 is an enlarged, side sectional view of the casting nozzle and throat assembly of FIG. 1.
Figure 3:
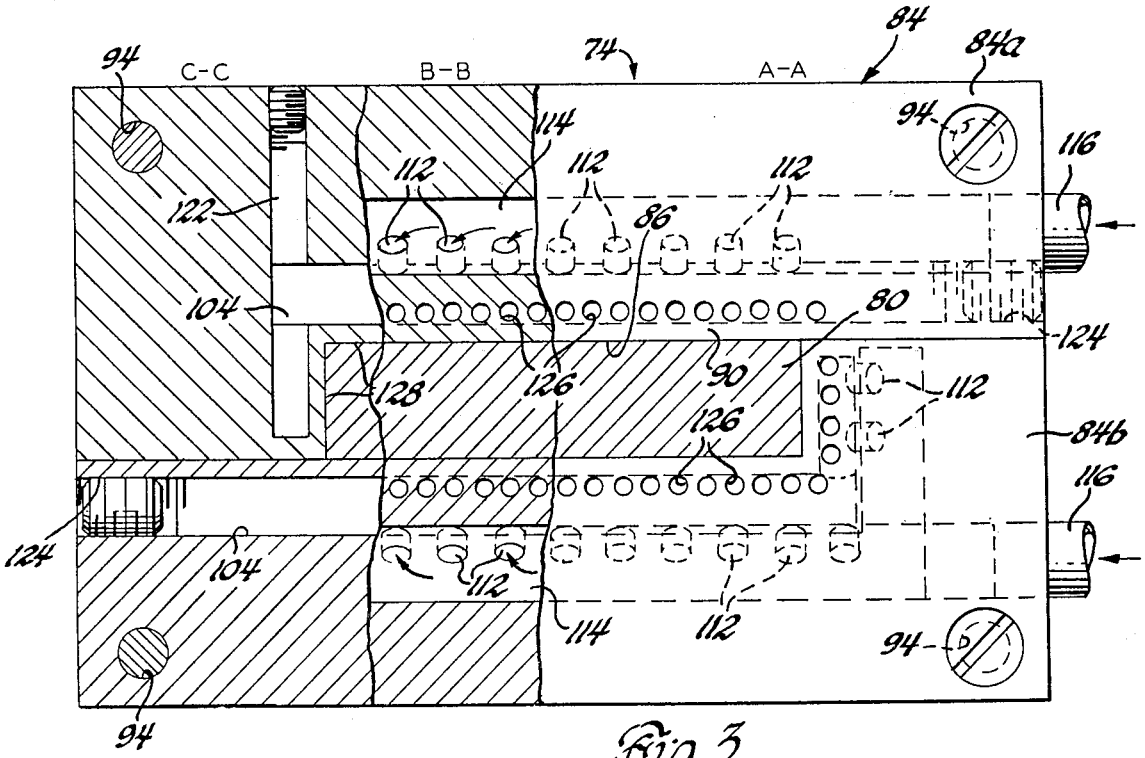
FIG. 3 is the casting nozzle of FIG. 2 broken away in the three planes A—A, B—B, and C—C of FIG. 2.

The casting nozzle and throat assembly 74 of FIG. 1 is enlarged and detailed more in FIGS. 2 and 3. This nozzle and throat assembly is particularly adapted for use with low melting point metals such as lead and alloys thereof (i.e., hereafter lead) and coolants which are readily vaporizable at the temperature of the melt in the casting zone. The casting nozzle itself comprises a heat conductive metal body 84 which may conveniently be formed from two L-shaped portions 84*a* and 84*b* bolted (not shown) together as best illustrated in FIG. 3. The metal body 84 has internal surfaces 126 defining a mold cavity 86 into which the melt enters at an inlet end 88 and exits solidified as strip 80 at outlet end 90. The body 84 has a sealing face 85 at the inlet end 88 which is provided with a sharp edged sealing land 92 around the periphery of the mouth of the mold cavity 86. The body 84 is bolted (i.e., through bolt holes 94) to a steel mounting plate 96 but spaced therefrom by a refractory, thermally insulating spacer 98 which preferably comprises Marinite (i.e., an asbestos-silica material). The refractory spacer 98 has an orifice 99 therethrough which comprises the casting throat for admitting melt to the mold cavity 86 from the casting block 14. A tight seal is required between the body 84 and the insulator 98 where they meet (hereafter freezing junction 100) at the mouth of the mold cavity 86 and where initial solidification occurs in the form of a thin skin 136. To this end, the body 84 is bolted tightly to the mounting plate 96 so as to sandwich the insulator 98 therebetween and impress the land 92 into the insulator 98 thereby providing a sharp, clean junction 100 for initiating freezing and skin formation. The insulator 98 has an elevated portion 105 around the orifice 99 which conforms to the inside of and nests within, an opening 102 in the mounting plate 96 so as to insulate the melt against chilling by the mounting plate 96.

The metal body 84 includes means for cooling the mold cavity 86, especially at the mouth thereof near the freezing junction 100. More specifically, a primary cooling channel 104 is provided around the inlet 88 to the mold cavity 86 and as close as possible to the freezing junction 100. During casting the surface 106 of channel 104 closest to the freezing junction 100 is the hottest and is diametrically opposed to a cooler surface 108 more remote from the junction 100. It has been found that the hot surface 106 becomes so hot during casting that readily vaporizable coolants 110 (e.g., water) vaporize upon contact therewith and in so doing form a thin insulating gaseous film on the surface 106 which substantially reduces the heat transfer from the surface 106 to the coolant 110. A plurality of ports 112 are therefor provided through the cool wall 108 along the full length of the channel 104 and such that the coolant 110 is admitted to the channel 104 therethrough and in such a manner as to impinge against the hot surface 106 and scrub away the gaseous, insulating film thereon. Coolant 110 is admitted to the ports 112 from a secondary cooling channel 114 formed in the body 84 so as to substantially parallel the primary cooling channel 104. In addition to providing coolant to the ports 112, the secondary cooling channel 114 serves to remove additional heat from the body 84 at regions more remote from the freezing junction 100 than the primary cooling channel 104. The secondary cooling channels 114 are coupled to an external source of coolant 110 via inlets 116 shown in FIG. 3. The ports 112 may conveniently be formed in the block 84 by drilling a plurality of access holes 118 (i.e., shown only in FIG. 2) and then sealing the access holes 118 as by a threaded plug 120. Similarly the cooling channels 104 and 114 may be formed the same way as illustrated in FIG. 3 by plugged access holes 122 and 124.

Coolant exits the primary channel 104 and the body 84 via a plurality of subsurface (i.e., mold surface 128) cooling passages 126 extending from the primary cooling channel 104 to the outlet end 90 of the body 84 to remove heat from the mold cavity 86 and promote continued solidification of the metal throughout the cavity 86. To promote still further cooling of the strip 80 the coolant exiting the passages 126 engage a baffle plate 130 at the outlet end 90 of the mold cavity 86 and is deflected onto the solidified strip 80 shortly after it exits the casting nozzle.

FIGS. 4–7 relate to casting nozzle and throat assemblies 74 particularly adapted for the continuous casting of low melting, low strength metals such as lead and have proved effective in the casting of Pb-Ca-Sn (i.e., 99+% Pb) strips (i.e., 3.2 in×0.75 in) at temperatures of about 670° F.–700° F. at rates up to about 8 ft/min. More specifically, the casting nozzle and throat assemblies 74 of FIGS. 4–7 all include a smooth, snag-resistant sealing member 132 at the inlet end 88 of the mold cavity 86, which sealing member 132 comprises an aromatic polyimide resin which is thermally stable at the casting temperature of the lead. Suitable polimides include those marketed commercially as Tribolon®, Thermamid® and Vespel® with the latter being most preferred for extended casting runs in the aforesaid 670° F.–700° F. temperature range. In this regard, the Vespel® material is more durable than other materials tested in that it required less frequent replacement than the others and could last eight hours or more without replacement or regrinding for another casting run. More specifically yet, excellent results have been achieved using filled or unfilled versions of the polyimide material marketed by DuPont Co. as Vespel SP-1 which is a high aromatic polymer of poly-N, N′ (P,P′-oxydiphenylene) pyromellitimide having the general formula $[(C_{22}H_{10}O_5N_2)]_x$. This material has a thermal stability exceeding 700° F., as determined by thermal gravimetric analysis at a heating rate of 15° C./min in an 80 ml/min air stream. The Vespel SP-1 material is further characterized by a density of about 1.42 to 1.44 g/cc (ASTM-D792), a Rockwell E hardness of about 45–75 (ASTM-D785), a tensile strength of at least 9,000 psi (ASTM-D1708), a minimum 3.5% elongation (ASTM-D1708), and a heat deflection of about 680° F. (ASTM-D648). Seals with as much as about 15% by weight graphite (i.e., about 5 microns) filler seem to perform the best. One such material (i.e., Vespel SP-21) has a density of about 1.49 to 1.52 g/cc, a Rockwell E hardness of about 25–55, a minimum tensile strength of about 5,200 psi and a minimum 1.7% elongation.

Figure 4:
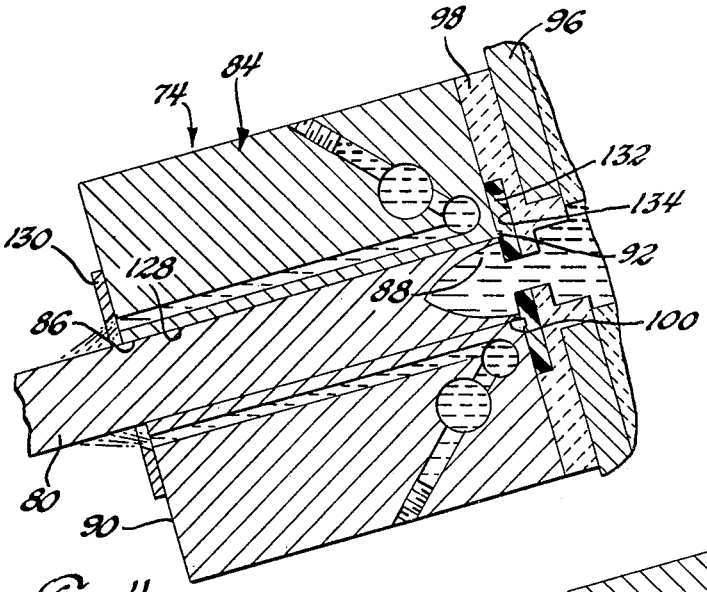
FIGS. 4–7 are side, sectional views of casting nozzle and throat assemblies useful for the continuous casting of lead from devices such as shown in FIG. 1. To the extent possible, the same reference numerals are used to designate similar structures in different embodiments.
Figure 5:
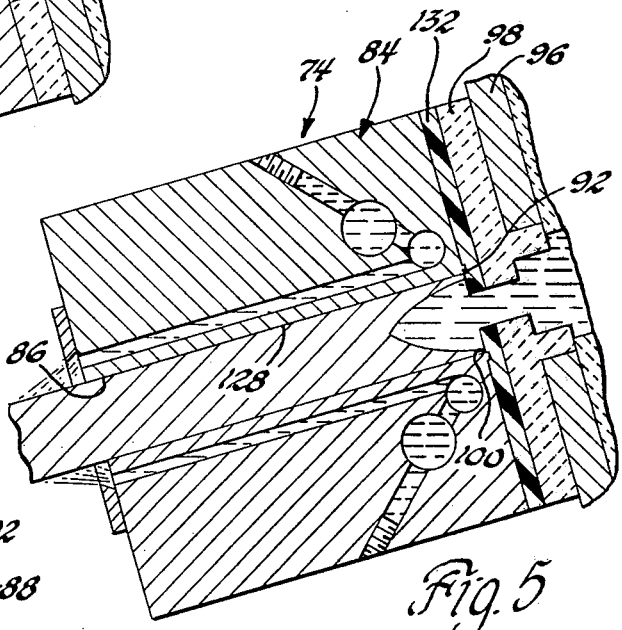

FIGS. 4 and 5 show essentially the same casting nozzle and throat assembly 74 as described in conjunction with FIGS. 2 and 3, but with the polyimide seals 132 positioned at the inlet 88 to the mold cavity 86 and forming the casting throat as shown. More specifically, FIG. 4 has the polyimide seal 132 positioned in a recess 134 formed in the Marinite insulator 98, whereas FIG. 5 has the polyimide seal 132 as a single plate filling the entire space between the nozzle 84 and Marinite insulator 98. In both instances, however, as also with FIGS. 6 and 7, the lands 92 compress the polyimide seal 132 to form a substantially perfect seal at the freezing junction 100 which prevents the molten lead from creeping between the seal and the body 84 to form flash or other potential sources for snagging or rupturing the thin, weak skin 136 solidifying at the junction 100. Such snagging, rupturing, etc. of the skins can cause unacceptable defects to be formed on the casting and significantly reduce the casting rate.

The casting nozzle and throat assemblies 74 of FIGS. 4 and 5 has proved effective for casting at rates up to about 3½ ft/min. At higher rates, there is a tendency to produce vibration in the nozzle 84. At certain amplitudes, this vibration has proved quite beneficial in permitting higher casting rates, but the structures shown in FIGS. 4 and 5 did not permit constant control of the vibration within the beneficial range. Rather, the vibrations obtained with the FIGS. 4 and 5 devices above about 3.5 ft/min casting rate were unstable and changed in both amplitude and frequency at random curing a single casting run and tended to cause large casting defects and aborted casting runs.

While the exact cause of the vibration is not entirely understood, it is believed to be the result of a freeze-shrink mechanism occurring within the nozzle. In this regard, the lead apparently freezes against the surface 128 of the mold cavity 86 and then as freezing continues it shrinks away from the surface 128. But when the shrinking occurs, the heat and pressure from the molten core behind it pushes the lead "skin" back against the surface 128 and the process repeats itself. This action is apparently the source of the vibration and the vibration itself is transmitted back into the sealing plate, where, due to its elasticity, it is amplified and transmitted into the casting at the mouth of the mold 88 where the skin is the thinnest and most vulnerable to rupture.

Figure 6:
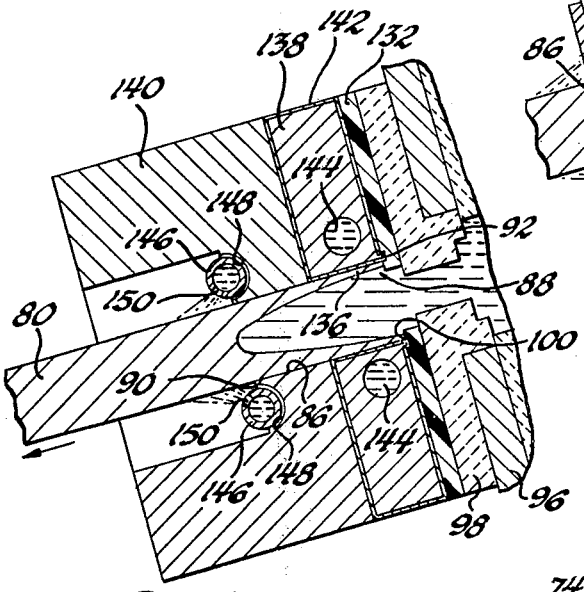
Figure 7:
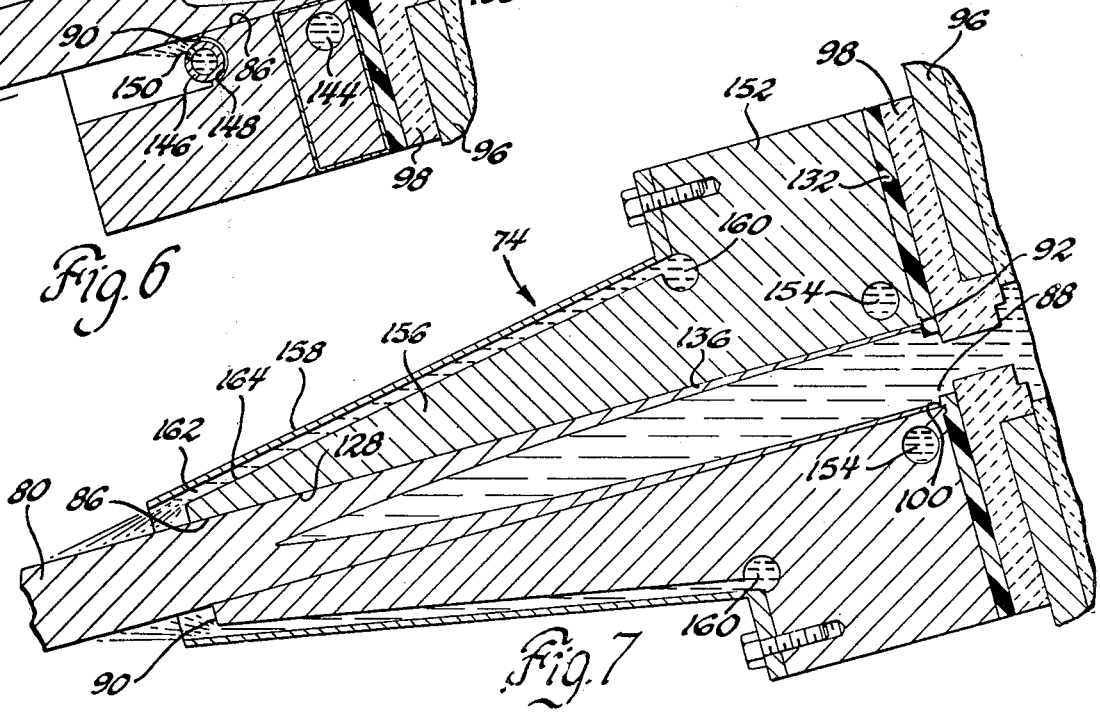

The casting nozzle and throat assemblies of FIGS. 6 and 7 permit casting speeds of about 8 ft/min using the polyimide sealing plate 132. The casting nozzle of FIG. 6 was designed to eliminate the vibration and did so by virtually eliminating the aforesaid "freeze-and-shrink" action. By comparison to the others, the FIG. 6 nozzle is short and adopted to very rapid cooling of the melt. Moreover, the mold cavity 86 was tapered from a maximum at the inlet 88 to a minimum at the outlet 90 and at a rate commensurate with the shrinkage rate of the cast strip thereby maintaining the metal-to-mold surface contact throughout the length of the nozzle. The nozzle itself comprises two distinct metal sections 138 and 140. Section 138 comprises a highly thermally conductive copper alloy body at the melt entrance to rapidly freeze the melt and form a thick initial skin 136. A thin chrome electrodeposit 142 is provided over the copper body to protect it from alloying, soldering, or the like with the lead melt. As before, a cooling channel 144 is provided around the inlet 88 of the mold cavity and in close proximity to the freezing junction 100 between the polyimide sealing plate 132 and the metal section 138. The second metal section 140 of the nozzle comprises stainless steel which is both thermally conductive and capable of withstanding prolonged casting runs without deterioration. Only a small portion of the stainless steel contacts the strip 80 with the remainder acting as a heat sink for the heat transmitted from the melt. Cooling of the small sections and the strip itself is provided by coolant conduits 146 which are provided in depressions 148 at the exit of the nozzle and ports 150 are provided in the conduits 146 for spewing the coolant onto the lead strip as it exits the nozzle.

The embodiments shown in FIG. 7 overcomes the 3½ ft/min casting rate limitation imposed by the vibration of the polyimide by stabilizing that vibration at levels which aid casting. Here, the nozzle body is made from aluminum and comprises a relatively large base portion 152 adjacent the melt source (i.e., near the inlet end 88 of the mold cavity 86). A cooling channel 154 is provided in the base portion 152 circumscribing the freeze junction 100. The remainder of the nozzle tapers externally as at 156 from the base portion 152 to the exit end 90 of the mold cavity. The tapered portion 156 of the nozzle is encased in a conforming sheet metal shroud 158. A secondary coolant 162 is introduced into channels 160 provided at the base of the shroud 158 and confined by the shroud 158 flows in a continuous sheet over the entire external surface 164 of the tapered portion 156. The coolant exits the nozzle so as to spray upon the solidified casting for still further cooling. The FIG. 7 structure provides a slow, controlled cooling of the melt and a prolonged formation of a thin skin 136. The effect of this slow cooling in the elongated (e.g., 9–12 in) tapering nozzle is to provide a very large contacting surface area 128 where the "freeze-shrink" action can occur which has proven successful in stabilizing the vibration to the point of permitting casting speeds of up to about 8 ft/min. While effective to produce higher casting rates these longer nozzles do have a tendency to form oxide and lead deposits on the inner surface 128 of the mold cavity which tend to affect the stability of the vibrations.

While the invention has been disclosed primarily in terms of specific embodiments thereof, it is not intended to be limited thereto but rather only to the extent hereinafter set forth in the claims which follow.

The embodiments of the invention in which an exclusive property or privilege is claimed are defined as follows:

1. In apparatus for continuously casting lengths of metal including a coolable mold, a source of melt coupled to the mold for continuously supplying melt to the mold during casting, a block of insulating material disposed between said mold and said source for substantially thermally isolating said mold from said source, and an orifice through said block for passing melt from said source to said mold, the improvement wherein said source comprises:

a container having a plurality of walls defining a reservoir for containing said melt;

a standpipe affixed to one of said walls and extending into said reservoir;

an inlet at the lower end of said standpipe for withdrawing melt from said reservoir;

a port in said standpipe adjacent said orifice and intermediate said lower end and the upper end of said standpipe for passing melt from said standpipe to said orifice;

control means at the upper end of said standpipe for maintaining a substantially constant level of melt in said standpipe above said port during casting, said level serving to establish a metalostatic head of melt pressing on the melt at the orifice and corresponding to the height of said level above said orifice;

pump means affixed to said standpipe for lifting melt from said reservoir to said level within said standpipe during casting and for rapidly dropping the melt level in said standpipe to beneath said orifice at the end of casting; and means associated with said standpipe and said one wall for readily detaching said standpipe from its associated wall for removal from said container, said means being located above said melt in said reservoir for easy access and such that said standpipe can be readily removed from said reservoir for servicing without emptying said reservoir or otherwise significantly disturbing the melt in the reservoir.

* * * * *